US009841024B2

(12) United States Patent
Hayashi et al.

(10) Patent No.: US 9,841,024 B2
(45) Date of Patent: Dec. 12, 2017

(54) COMPRESSOR AND METHOD FOR PRODUCING COMPRESSOR

(71) Applicant: DAIKIN INDUSTRIES, LTD., Osaka-shi, Osaka (JP)

(72) Inventors: Takeo Hayashi, Kusatsu (JP); Yasuto Hiraoka, Kusatsu (JP); Seio Miyata, Kusatsu (JP); Naoto Sekida, Kusatsu (JP); Yoshinobu Ishiodori, Kusatsu (JP); Kouji Tanaka, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/032,594

(22) PCT Filed: Oct. 3, 2014

(86) PCT No.: PCT/JP2014/076526
§ 371 (c)(1),
(2) Date: Apr. 27, 2016

(87) PCT Pub. No.: WO2015/064300
PCT Pub. Date: May 7, 2015

(65) Prior Publication Data

US 2016/0273537 A1 Sep. 22, 2016

(30) Foreign Application Priority Data

Oct. 29, 2013 (JP) ..... 2013-224520

(51) Int. Cl.
*F04C 29/12* (2006.01)
*F04B 39/12* (2006.01)
(Continued)

(52) U.S. Cl.
CPC ..... *F04C 29/12* (2013.01); *F04B 39/123* (2013.01); *F04B 39/14* (2013.01); *F04C 29/065* (2013.01);
(Continued)

(58) Field of Classification Search
CPC ..... F04C 29/06; F04C 29/065; F04C 29/068; F04C 2240/30; F04C 2250/101; F04C 29/124; F04C 29/126
See application file for complete search history.

(56) References Cited

U.S. PATENT DOCUMENTS 6,106,242 A * 8/2000 Sung ..... F04C 29/0035 417/312
6,241,496 B1 * 6/2001 Kim ..... F04C 29/068 418/181
(Continued)

FOREIGN PATENT DOCUMENTS

CN 1295195 A 5/2001
CN 1519474 A 8/2004
(Continued)

OTHER PUBLICATIONS

International Search Report of corresponding PCT Application No. PCT/JP2014/076526 dated Dec. 22, 2014.
(Continued)

*Primary Examiner* — Bryan Lettman
(74) *Attorney, Agent, or Firm* — Global IP Counselors, LLP

(57) ABSTRACT

A compressor includes compression and drive mechanisms disposed in a casing having a cylindrical member. The compression mechanism includes a cylinder main body, an end surface member attached to the cylinder main body, a muffler main body attached to the end surface member, an intake hole communicating with the compression chamber and extending in a direction crossing the drive shaft, and a circular hole located radially outside the compression chamber and extending in a direction parallel to the drive shaft. The circular hole opens to a space inside the casing. At least a part of the circular hole is located within an area defined by extending the intake hole in a plan view. A method of
(Continued)

producing a compressor includes inserting a positioning pin into the circular hole of the compression mechanism and pressing an inlet tube into the intake hole from outside of the cylindrical member.

4 Claims, 9 Drawing Sheets

(51) Int. Cl.

| | |
|---|---|
| ***F04B 39/14*** | (2006.01) |
| ***F04C 29/06*** | (2006.01) |
| *F01C 21/10* | (2006.01) |
| *F04C 23/00* | (2006.01) |
| *F04C 18/356* | (2006.01) |
| *F04C 29/00* | (2006.01) |

(52) U.S. Cl.

CPC ..... *F01C 21/10* (2013.01); *F04C 18/356* (2013.01); *F04C 18/3564* (2013.01); *F04C 23/008* (2013.01); *F04C 29/0085* (2013.01); *F04C 2230/60* (2013.01); *F04C 2240/30* (2013.01); *F04C 2240/40* (2013.01); *F04C 2240/806* (2013.01)

(56) References Cited

U.S. PATENT DOCUMENTS

| | | | | |
|---|---|---|---|---|
| 6,287,098 | B1 * | 9/2001 | Ahn | F04C 29/068 418/181 |
| 7,229,257 | B2 * | 6/2007 | Ko | F04C 29/023 417/312 |
| 8,337,185 | B2 | 12/2012 | Tanaka | |
| 2004/0154330 | A1 | 8/2004 | Ko et al. | |
| 2009/0293534 | A1 | 12/2009 | Tanaka | |
| 2012/0308425 | A1 * | 12/2012 | Morishita | F04C 18/3564 418/259 |
| 2013/0280116 | A1 * | 10/2013 | Hayashi | F01C 21/08 418/55.2 |
| 2014/0250937 | A1 * | 9/2014 | Hirayama | F04C 23/008 62/296 |

FOREIGN PATENT DOCUMENTS

| | | | |
|---|---|---|---|
| CN | 101592152 | A | 12/2009 |
| JP | 2001-173559 | A | 6/2001 |
| JP | 2008-163874 | A | 7/2008 |
| JP | 2010-150973 | A | 7/2010 |
| JP | 2012-251485 | A | 12/2012 |
| JP | 2013-83245 | A | 5/2013 |
| WO | WO2012090760 | * | 5/2012 |
| WO | 2013/047307 | A1 | 4/2013 |

OTHER PUBLICATIONS

International Preliminary Report of corresponding PCT Application No. PCT/JP2014/076526 dated May 12, 2016.

European Search Report of corresponding EP Application No. 14 85 7709.1 dated Nov. 30, 2016.

* cited by examiner

COMPRESSOR AND METHOD FOR PRODUCING COMPRESSOR

CROSS-REFERENCE TO RELATED APPLICATIONS

This U.S. National stage application claims priority under 35 U.S.C. §119(a) to Japanese Patent Application No. 2013-224520, filed in Japan on Oct. 29, 2013, the entire contents of which are hereby incorporated herein by reference.

TECHNICAL FIELD

The present invention relates to: a compressor such as a rotary compressor used in, for example, an air conditioner; and a method for producing the compressor.

BACKGROUND ART

Compressors in general include a compression mechanism and a drive mechanism which are disposed in a casing. The compression mechanism includes: a cylinder including a compression chamber; and end surface members respectively disposed on both end surfaces of the cylinder. In the compression chamber, a roller driven by a drive shaft is disposed. The drive mechanism includes a stator and a rotor. The stator is fixed to an inner circumferential surface of the casing. The rotor is disposed inside the stator, and is configured to rotate with the drive shaft. The compression mechanism further includes an intake hole communicating with the compression chamber. In the intake hole, an inlet tube is pressed, through which refrigerant is supplied to the compression chamber.

In a process of assembling the above-described compressor, the compression mechanism having the drive shaft is placed on a support table. At this time, an assembly-purpose positioning pin fixed to the support table is inserted in an assembly-purpose positioning hole of the cylinder (compression mechanism), so that positioning is performed. Thereafter, the rotor is attached to the drive shaft, and then a spacer is disposed so as to be opposed to an outer circumferential surface of the rotor. Then, a cylindrical member (a part of the casing) with the stator fixed to an inner circumferential surface of the cylindrical member is disposed outside the compression mechanism in such a manner that the spacer is located between the outer circumferential surface of the rotor and an inner circumferential surface of the stator. Then, after the inlet tube is pressed in the intake hole from the outside of the cylindrical member, the compression mechanism is fixed to the inner circumferential surface of the cylindrical member by welding.

SUMMARY

Technical Problem

In the process of assembling the compressor, positioning is performed by inserting the assembly-purpose positioning pin fixed to the support table into the assembly-purpose positioning hole of the cylinder (compression mechanism). There is however a configuration in which the assembly-purpose positioning hole is located at a position deviating from a pressed-in direction of the inlet tube, as shown in FIG. 9. In such a configuration, when the inlet tube is pressed into an intake hole 950 of a cylinder 921, a force in a direction of rotation about an assembly-purpose positioning pin 60 inserted in a circular hole 956 is exerted to the cylinder 921. The force causes rotational movement of the cylinder 921 around the assembly-purpose positioning pin 60. Along with this, the rotor attached to the drive shaft also rotationally moves, unfortunately. The rotor presses the spacer in the direction of the rotation of the rotor, and this decreases an air gap (air gap between the outer circumferential surface of the rotor and the inner circumferential surface of the stator) at a position corresponding to the pressed portion of the spacer. When the spacer is detached under the above circumstances after the cylinder 921 is fixed to the inner circumferential surface of the cylindrical member by welding, the air gap is not uniform throughout the entire circumference. This may cause a problem of an increase in noise from the compressor in operation.

In view of the above, an object of the present invention is to provide a compressor in which an air gap is uniform throughout the entire circumference, and a method for producing the compressor.

Solution to Problem

According to the first aspect of the invention, a compressor includes a compression mechanism and a drive mechanism which are disposed in a cylindrical member, the drive mechanism including: a stator fixed to an inner circumferential surface of the cylindrical member; and a rotor disposed inside the stator, the rotor being configured to rotate with a drive shaft, the compression mechanism including: a cylinder main body including a compression chamber in which a roller driven by the drive shaft is disposed; an end surface member attached to an end surface of the cylinder main body; an intake hole communicating with the compression chamber and extending in a direction crossing the drive shaft; and a circular hole located radially outside the compression chamber and extending in a direction parallel to the drive shaft. At least a part of the circular hole is located within an area defined by extending the intake hole in a plan view.

According to the fifth aspect of the invention, a method for producing a compressor includes: a first step of positioning a compression mechanism including a compression chamber on a support table by inserting an assembly-purpose positioning pin fixed to the support table into a circular hole of the compression mechanism, the circular hole being located radially outside the compression chamber in which a roller driven by a drive shaft is disposed, the circular hole extending in a direction parallel to the drive shaft; a second step of attaching the rotor to the drive shaft; a third step of disposing a spacer so that the spacer is opposed to an outer circumferential surface of the rotor; a fourth step of disposing a cylindrical member to which a stator is fixed so that the spacer is located between the outer circumferential surface of the rotor and an inner circumferential surface of the stator; and a fifth step of pressing an inlet tube into an intake hole from an outside of the cylindrical member, the intake hole communicating with the compression chamber in the compression mechanism and extending in a direction crossing the drive shaft. At least a part of the circular hole is located within an area defined by extending the intake hole in a plan view.

In this compressor and the method for producing the compressor, the compression mechanism has the circular hole, and at least a part of the circular hole is located within the area defined by extending the intake hole in a plan view. This circular hole is useable as an assembly-purpose positioning hole in the process of assembling the compressor. Now, suppose the situation where the compression mechanism is positioned by inserting the assembly-purpose positioning pin fixed to the support table into the circular hole (assembly-purpose positioning hole) in the process of assembling the compressor. When the inlet tube is pressed into the intake hole in this situation, a force in a direction of rotation about the positioning hole is hardly exerted to the compression mechanism. As a result, rotation of the compression mechanism about the assembly-purpose positioning pin is suppressed when the inlet tube is pressed in the intake hole in the process of assembling the compressor. This makes the air gap uniform throughout the entire circumference, to prevent an increase in noise from the compressor in operation.

According to the second aspect, the compressor of the first aspect is arranged such that the circular hole is formed by machining or sintering.

In this compressor, because the circular hole is formed by machining or sintering, it is less likely that there is variation in the inner diameter size of the hole. For this reason, when the circular hole is used as the assembly-purpose positioning hole in the process of assembling the compressor, the compression mechanism is properly positioned.

According to the third aspect, the compressor of the first or second aspect is arranged such that the intake hole and the circular hole are located in a single member.

In this compressor, because the intake hole and the circular hole are located in the single member, a difference in height is small between the intake hole and the circular hole (including the case where the intake hole and the circular hole are located at substantially the same height). Accordingly, when the inlet tube is pressed in the intake hole in the process of assembling the compressor, it is possible to restrain inclination of the compression mechanism with respect to a height direction.

According to the fourth aspect, the compressor of any of the first to third aspects is arranged such that a center of the circular hole is located within the area defined by extending the intake hole in a plan view.

In this compressor, the center of the circular hole is located within the area defined by extending the intake hole in a plan view. Therefore, in the situation where the circular hole is used as the assembly-purpose positioning hole in the process of assembling the compressor, the rotation of the compression mechanism about the assembly-purpose positioning pin is prevented when the inlet tube is pressed in the intake hole at the time of assembling the compressor. This makes the air gap uniform throughout the entire circumference, to effectively prevent an increase in noise from the compressor in operation.

Advantageous Effects of Invention

As described hereinabove, the present invention brings about the following effects.

In the first and fifth aspects, the compression mechanism has the circular hole, and at least a part of the circular hole is located within the area defined by extending the intake hole in a plan view. This circular hole is useable as an assembly-purpose positioning hole in the process of assembling the compressor. Now, suppose the situation where the compression mechanism is positioned by inserting the assembly-purpose positioning pin fixed to the support table into the circular hole (assembly-purpose positioning hole) in the process of assembling the compressor. When the inlet tube is pressed into the intake hole in this situation, a force in a direction of rotation about the positioning hole is hardly exerted to the compression mechanism. As a result, rotation of the compression mechanism about the assembly-purpose positioning pin is suppressed when the inlet tube is pressed in the intake hole in the process of assembling the compressor. This makes the air gap uniform throughout the entire circumference, to prevent an increase in noise from the compressor in operation.

In the second aspect, because the circular hole is formed by machining or sintering, it is less likely that there is variation in the inner diameter size of the hole. For this reason, when the circular hole is used as the assembly-purpose positioning hole in the process of assembling the compressor, the compression mechanism is properly positioned.

In the third aspect, because the intake hole and the circular hole are located in the single member, a difference in height is small between the intake hole and the circular hole (including the case where the intake hole and the circular hole are located at substantially the same height). Accordingly, when the inlet tube is pressed in the intake hole in the process of assembling the compressor, it is possible to restrain inclination of the compression mechanism relative to the height direction.

In the fourth aspect, the center of the circular hole is located within the area defined by extending the intake hole in a plan view. Therefore, in the situation where the circular hole is used as the assembly-purpose positioning hole in the process of assembling the compressor, the rotation of the compression mechanism about the assembly-purpose positioning pin is prevented when the inlet tube is pressed in the intake hole at the time of assembling the compressor. This makes the air gap uniform throughout the entire circumference, to effectively prevent an increase in noise from the compressor in operation.

DESCRIPTION OF EMBODIMENTS

The following will describe the invention in detail with reference to illustrated embodiments.

First Embodiment

Figure 1:
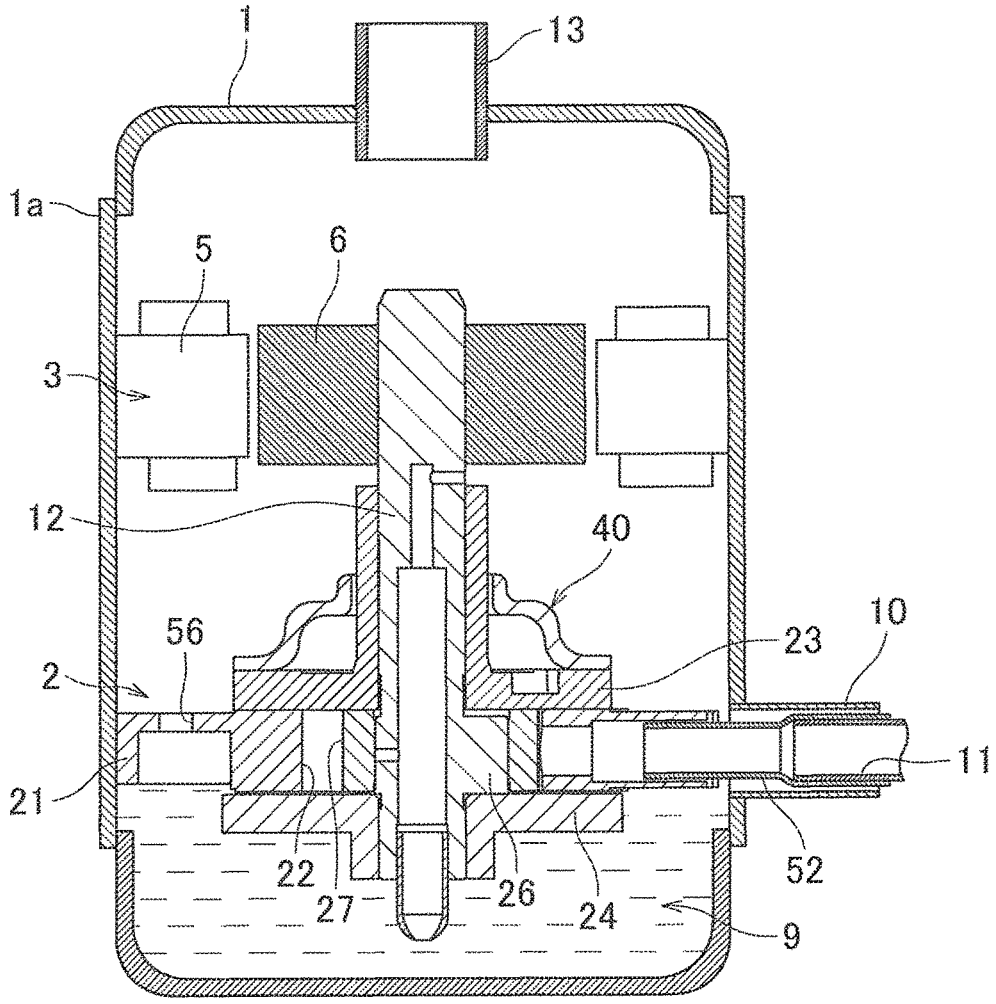
FIG. 1 is a cross section of a compressor of the first embodiment of the present invention.

FIG. 1 is a cross section of a compressor of an embodiment of the present invention. This compressor is a so-called high-pressure dome-shaped rotary compressor. In a casing 1 of the compressor, a compression mechanism 2 is disposed in a lower portion, and a motor 3 is disposed in an upper portion. The compression mechanism 2 is configured to be driven by a rotor 6 of the motor 3 through a drive shaft 12.

The compression mechanism 2 takes in a refrigerant from an accumulator through an intake pipe 11. The thus taken refrigerant is obtained by controlling a condenser, an expansion mechanism, and an evaporator (these are not illustrated) as well as the compressor. These members constitute an air conditioner which is an example of a refrigeration system. The intake pipe 11 is fixed to an inlet tube 52 by brazing in a joint pipe 10 disposed on an outer circumferential surface of the casing 1. The inlet tube 52 is pressed in an intake hole 50 of a cylinder main body 21.

The compressor is configured as follows: high-temperature and high-pressure compressed discharge gas is discharged from the compression mechanism 2, with which gas the inside of the casing 1 is filled; and the gas passes through a gap between a stator 5 and the rotor 6 of the motor 3, to cool the motor 3, and then the gas is discharged to the outside through a discharge pipe 13. Lubricating oil 9 is retained in a portion in the casing 1 which is below a high-pressure area.

Figure 2A:
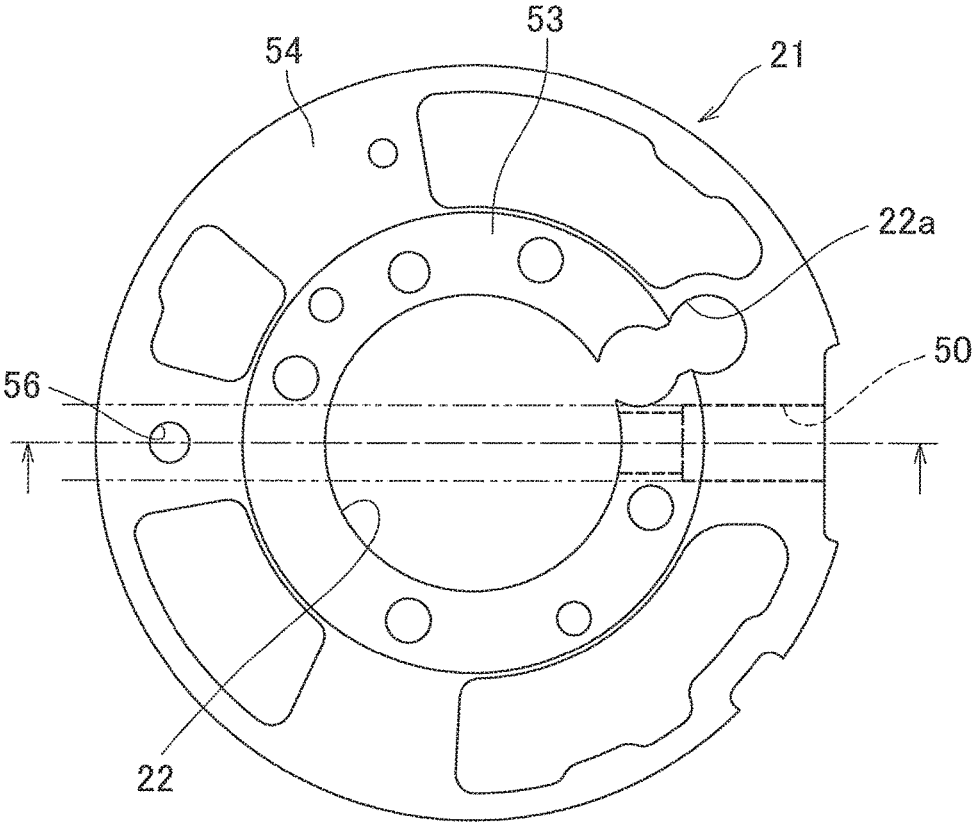
FIG. 2A is a plan view of a cylinder main body of the compressor of FIG. 1.
Figure 2B:
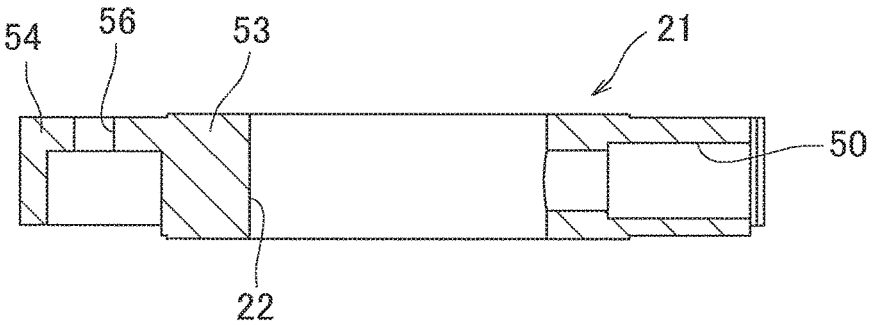
FIG. 2B is a cross section of the cylinder main body.

As shown in FIG. 1 and FIGS. 2A and 2B, the compression mechanism 2 includes: a cylinder main body 21 forming a cylinder chamber 22; and an upper end surface member 23 and a lower end surface member 24 which are respectively attached to upper and lower end surfaces of the cylinder main body 21 to close the compression chamber (cylinder chamber) 22. The drive shaft 12 penetrates the upper end surface member 23 and the lower end surface member 24 and enters the compression chamber 22. In the compression chamber 22, a roller 27 is disposed so as to be able to revolve. The roller 27 is fitted around a crank pin 26 provided to the drive shaft 12. This revolving motion of the roller 27 creates compression operation. The compression chamber 22 is structured to be partitioned by a blade provided integrally with the roller 27 into a high-pressure area and a low-pressure area. Semicircular-shaped bushes are respectively in close contact with both sides of the blade, to provide sealing. The cylinder main body 21 has an accommodation hole 22*a* located outside the compression chamber 22 and communicating with the compression chamber 22. In this accommodation hole 22*a*, the blade and the bushes are accommodated.

As shown in FIGS. 2A and 2B, the cylinder main body 21 includes: a cylindrical portion 53 located around the compression chamber 22; and a support portion 54 extending from an outer circumferential surface of the cylindrical portion 53 to an inner circumferential surface of the casing 1. The cylinder main body 21 has an intake hole 50. The intake hole 50 communicates with the compression chamber 22 and extends in a horizontal direction (a direction crossing the drive shaft 12). To an upper surface of the cylindrical portion 53, the end surface member 23 is fixed. The upper surface has an outline substantially the same as that of the end surface member 23. The cylinder main body 21 further has a circular hole 56 in the support portion 54. The hole 56 is located outside the cylindrical portion 53. The circular hole 56 is located radially outside the compression chamber 22 and radially outside the end surface member 23, and extends in a direction parallel to the drive shaft 12. In a plan view, the center of the circular hole 56 is located within an area defined by extending the intake hole 50 (i.e., an area between two-dot chain lines which are extension lines from an end portion of the intake hole 50 in FIG. 2A). In the plan view of FIG. 2A, the center of the circular hole 56 is on the center line of the intake hole 50. The circular hole 56 is formed by machining or sintering. Further, as shown in FIG. 2B, a part of the support portion 54 at which the circular hole 56 is located has a recess opening downward. The circular hole 56 is located at an upper thin portion of this part of the support portion 54. Thus, while the circular hole 56 and the intake hole 50 are both located in the cylinder main body 21, the circular hole 56 is located higher than the intake hole 50, relative to a height direction of the compressor, as shown in FIG. 2B.

Figure 3:
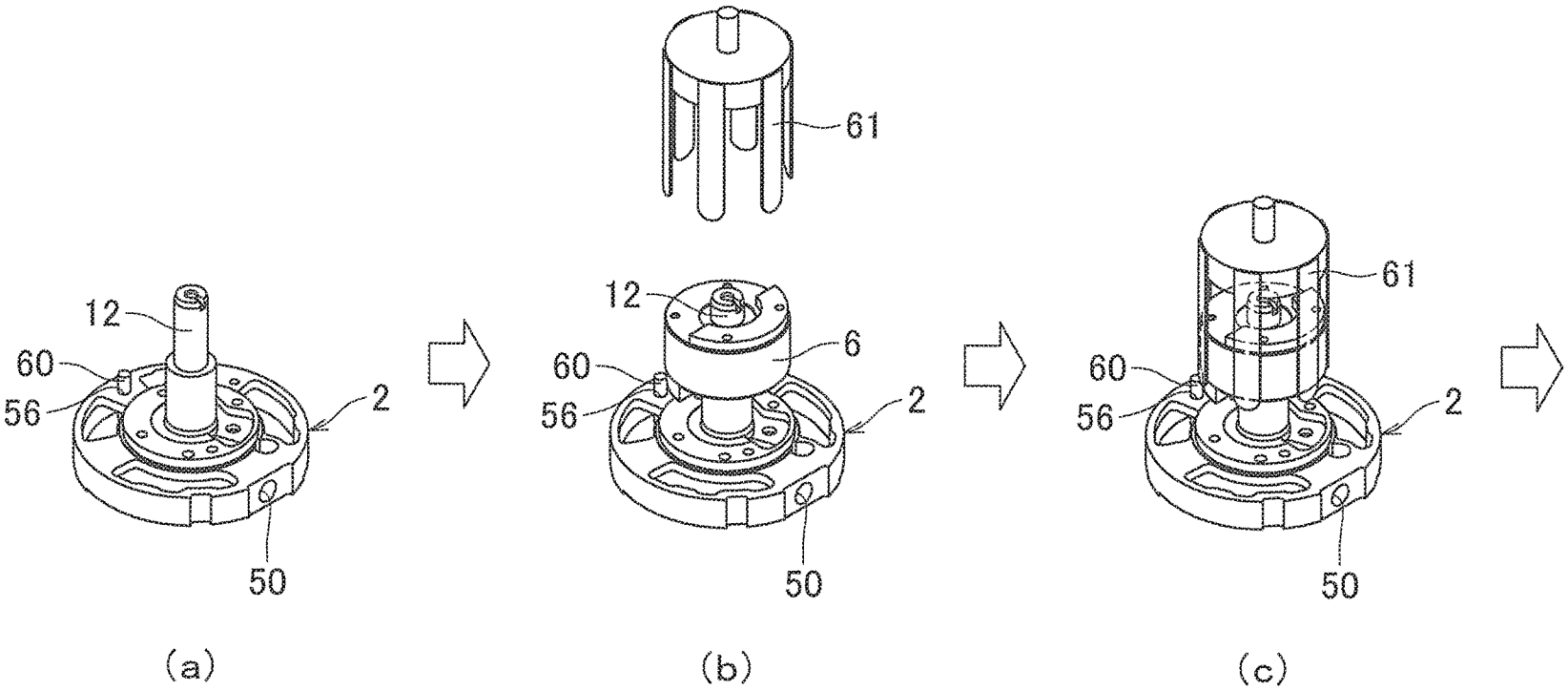
FIG. 3 is a diagram showing a process of assembling the compressor of FIG. 1.
Figure 4:
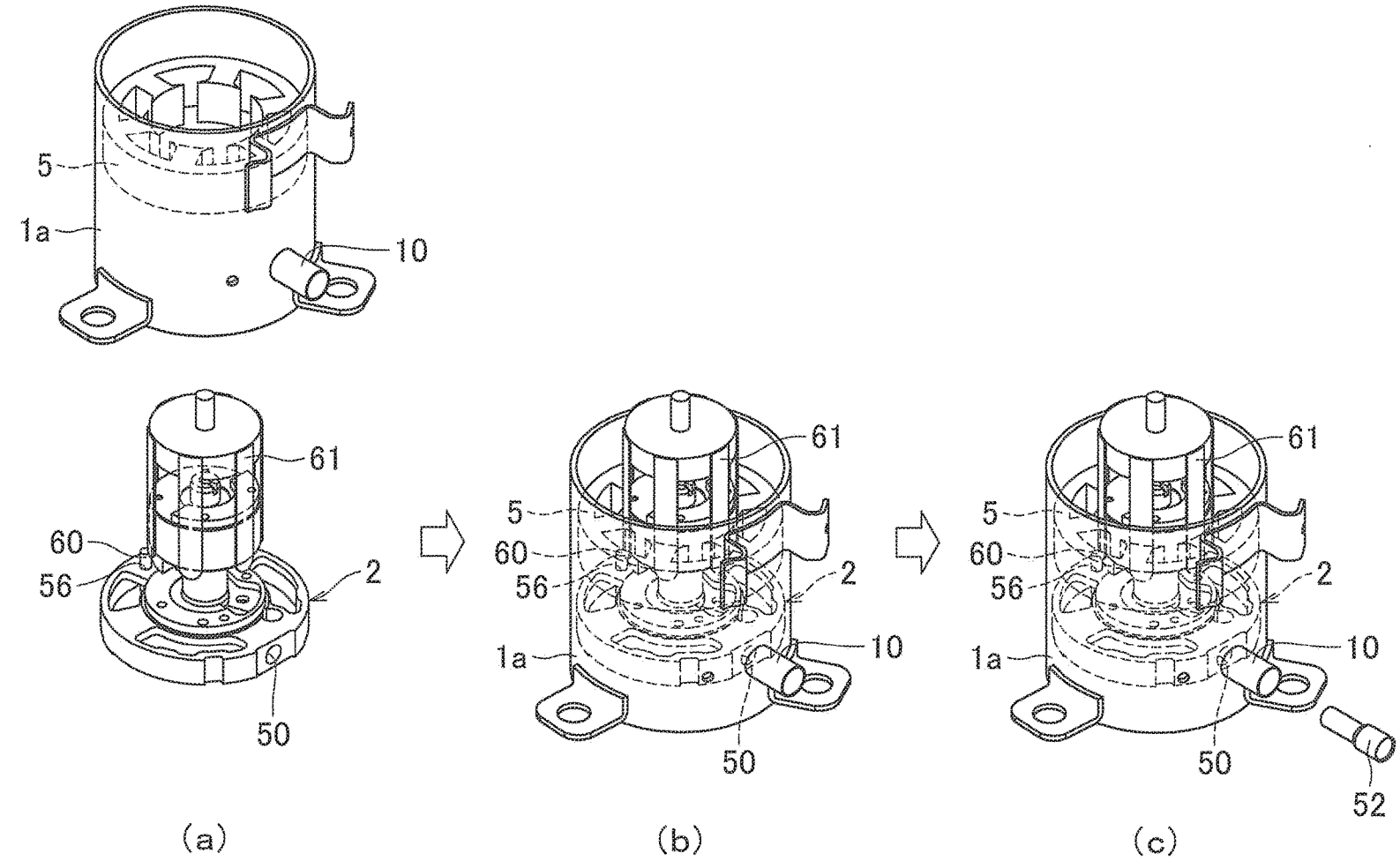
FIG. 4 is a diagram showing the process of assembling the compressor of FIG. 1.

The following will describe a process of assembling the compressor, with reference to FIG. 3 and FIG. 4. First, as shown in (a) of FIG. 3, the compression mechanism 2 including the drive shaft 12 is placed on a support table. An assembly-purpose positioning pin 60 fixed to the support table is inserted at this time into the circular hole 56 of the cylinder main body 21, so that the compression mechanism 2 is positioned on the support table. For this purpose, the assembly-purpose positioning pin 60 has a circular horizontal cross-section, which is structured to have substantially the same size as that of the circular hole 56. The compression mechanism 2 is constituted by members such as the cylinder main body 21, the end surface members 23 and 24, the drive shaft 12, and a muffler main body 40, and the like. In FIG. 3 and FIG. 4, some of these members are not illustrated. Meanwhile, the stator 5, which is a component of the motor 3, has copper wire wound therearound. As electricity is supplied through the copper wire from the outside of the casing, the rotor 6 having a magnet is driven. In the figures, some members and wiring in the motor 3 are not illustrated. As shown in (b) of FIG. 3, the rotor 6 is attached to the drive shaft 12. Then, a spacer 61 is disposed to be opposed to an outer circumferential surface of the rotor 6, as shown in (c) of FIG. 3. In this process, the spacer 61 is disposed to be opposed to the outer circumferential surface all over the circumference of the rotor 6. Thereafter, as shown in (a) and (b) of FIG. 4, the cylindrical member 1*a* (a part of the casing 1) with the stator 5 fixed to an inner circumferential surface of the cylindrical member 1*a* is disposed outside the compression mechanism 2 in such a manner that the spacer 61 is located between the outer circumferential surface of the rotor 6 and an inner circumferential surface of the stator 5. With this, the joint pipe 10 provided on an outer circumferential surface of the cylindrical member 1*a* faces the intake hole 50 of the cylinder main body 21. Then, the inlet tube 52 is pressed into the intake hole 50 from the outside of the cylindrical member 1*a*, as shown in (c) of FIG. 4. After that, an outer circumferential surface of the cylinder main body 21 is fixed to the inner circumferential surface of the cylindrical member 1*a* by welding.

Figure 5:
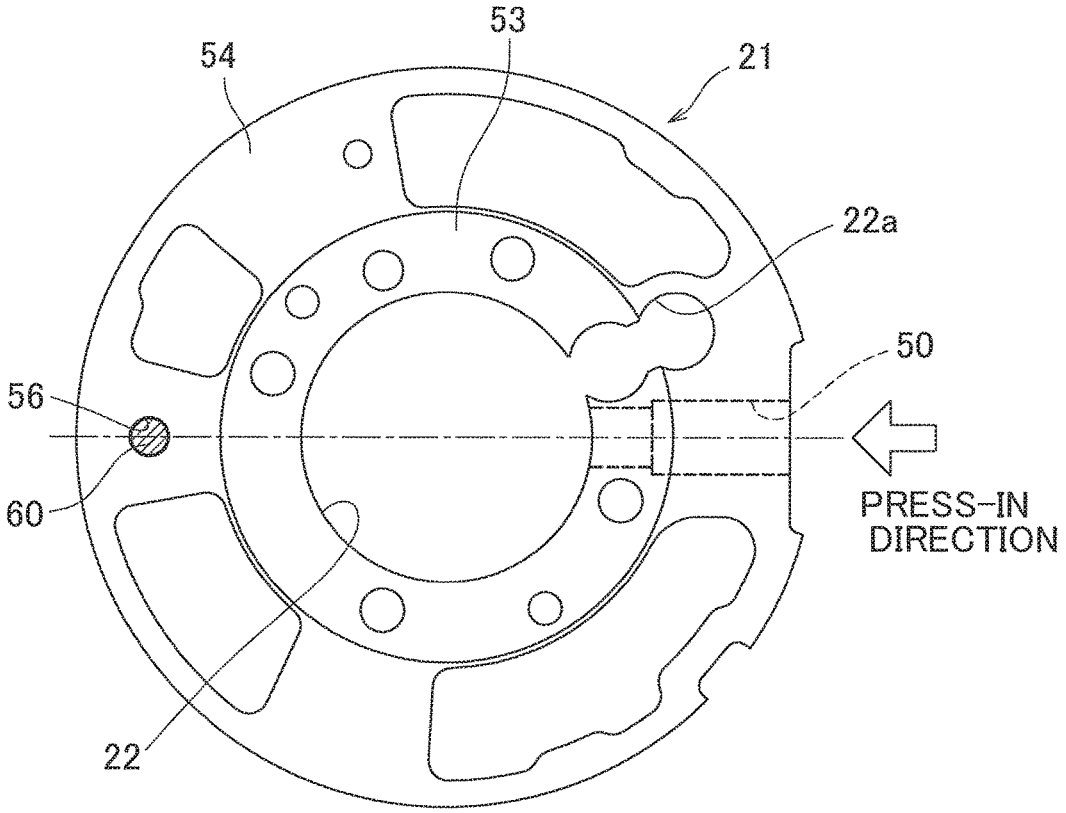
FIG. 5 is a diagram showing a state where an inlet tube is pressed in the cylinder main body of the compressor of the present invention.
Figure 9:
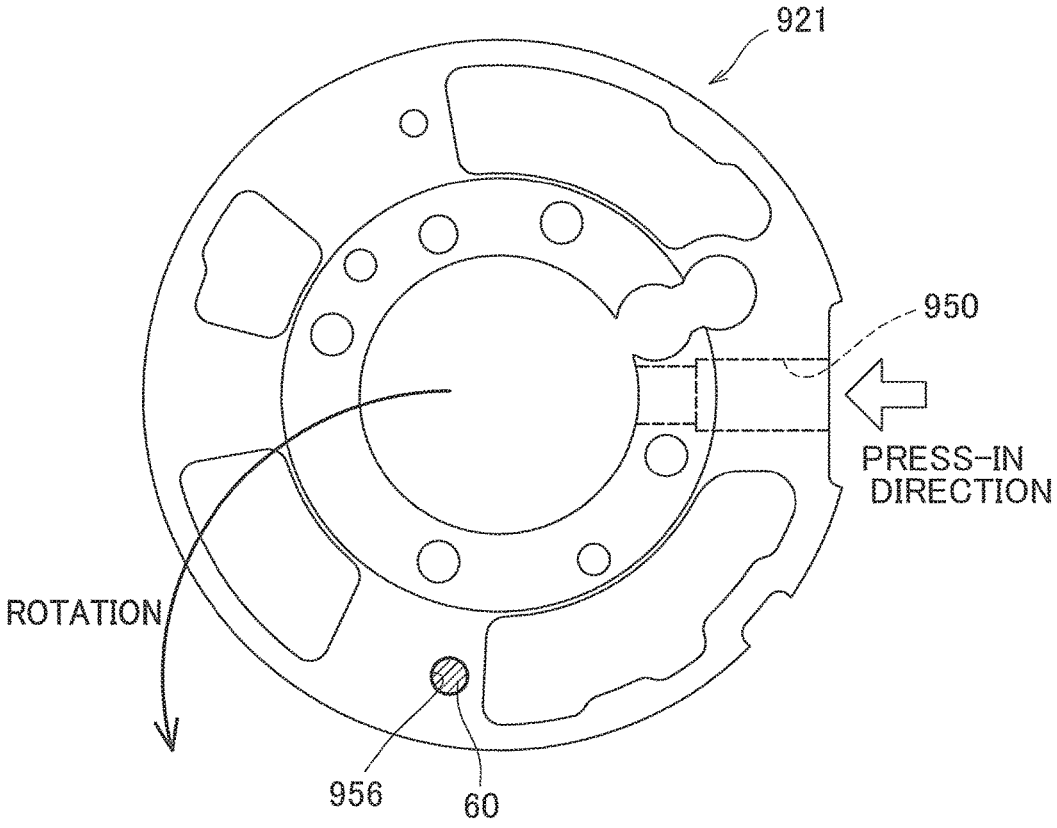
FIG. 9 is a diagram showing a state where an inlet tube is pressed in a cylinder main body of a known compressor.

In the process of assembling the compressor, the circular hole 56 of the cylinder main body 21 is used as an assembly-purpose positioning hole. Therefore, when the inlet tube 52 is pressed into the intake hole 50 in the situation where the assembly-purpose positioning pin 60 is inserted in the circular hole 56 of the cylinder main body 21, a force in a direction toward the assembly-purpose positioning pin 60 (circular hole 56) is exerted on the cylinder main body 21, as shown in FIG. 5. Because the assembly-purpose positioning pin 60 is at a position in a direction of the above-mentioned force exerted, the assembly-purpose positioning pin 60 prevents the cylinder main body 21 (compression mechanism 2) from being moved (rotationally moved) by this force. This prevents problems take place in a process of assembling a known compressor (FIG. 9) including a cylinder main body 921: a problem of the cylinder main body 921 rotationally moving about the assembly-purpose positioning pin 60; and a problem of the rotor 6 attached to the drive shaft 12 also rotationally moving with the cylinder main body 921. For this reason, a part of the spacer 61 with respect to a circumferential direction of the rotor 6 (cylinder main body 21) is not pressed. Accordingly, an air gap (air gap between the outer circumferential surface of the rotor 6 and the inner circumferential surface of the stator 5) is uniform throughout the entire circumference. When the spacer 61 is detached under the circumstances after the cylinder main body 21 is fixed to the inner circumferential surface of the cylindrical member 1*a* by welding, the air gap remains uniform throughout the entire circumference.

Characteristics of Compressor of this Embodiment

In this compressor and the method for producing the compressor, the compression mechanism 2 has the circular hole 56, and the center of the circular hole 56 is located within the area defined by extending the intake hole 50 in a plan view. This circular hole 56 is useable as an assembly-purpose positioning hole in the process of assembling the compressor. Now, suppose the situation where the compression mechanism 2 is positioned by inserting the assembly-purpose positioning pin 60 fixed to the support table into the circular hole 56 (assembly-purpose positioning hole) in the process of assembling the compressor. When the inlet tube 52 is pressed into the intake hole 50 in this situation, a force in a direction of rotation about the positioning pin 60 is hardly exerted to the compression mechanism 2. As a result, rotation of the compression mechanism 2 about the assembly-purpose positioning pin 60 is suppressed when the inlet tube 52 is pressed in the intake hole in the process of assembling the compressor. This makes the air gap uniform throughout the entire circumference, to prevent an increase in noise from the compressor in operation.

In the compressor of this embodiment, the circular hole 56 is formed by machining or sintering. For this reason, when the circular hole 56 is used as the assembly-purpose positioning hole in the process of assembling the compressor, the compression mechanism 2 is properly positioned.

In the compressor of this embodiment, because the intake hole 50 and the circular hole 56 are both located in the cylinder main body 21, the difference in height is small between the intake hole 50 and the circular hole circular hole 56. Accordingly, when the inlet tube 52 is pressed in the intake hole in the process of assembling the compressor, it is possible to restrain inclination of the compression mechanism 2 relative to the height direction.

In the compressor of this embodiment, the center of the circular hole 56 is located within the area defined by extending the intake hole 50 in a plan view. Therefore, in the situation where the circular hole 56 is used as the assembly-purpose positioning hole in the process of assembling the compressor, the rotation of the compression mechanism 2 about the assembly-purpose positioning pin is prevented when the inlet tube 52 is pressed in the intake hole 50 at the time of assembling the compressor. This makes the air gap uniform throughout the entire circumference, to effectively prevent an increase in noise from the compressor in operation.

Second Embodiment

Figure 6:
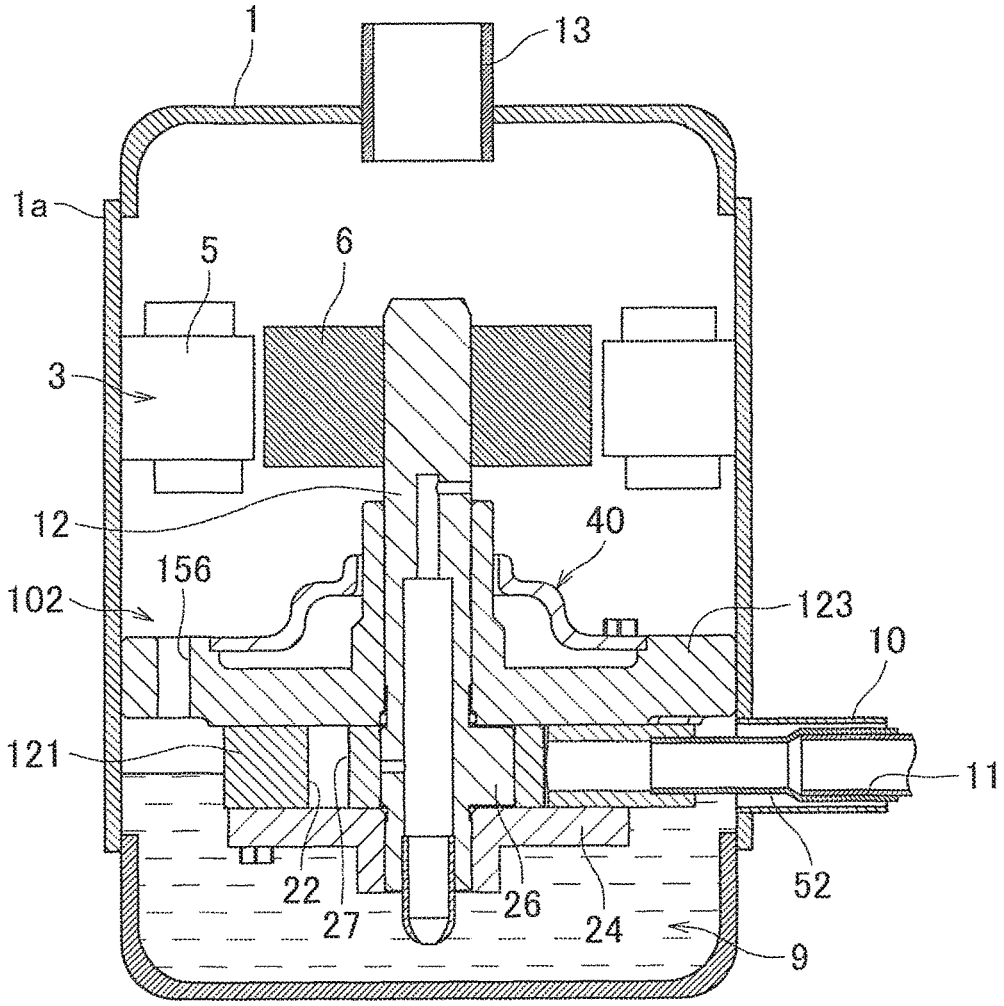
FIG. 6 is a cross section of a compressor of the second embodiment of the present invention.
Figure 7A:
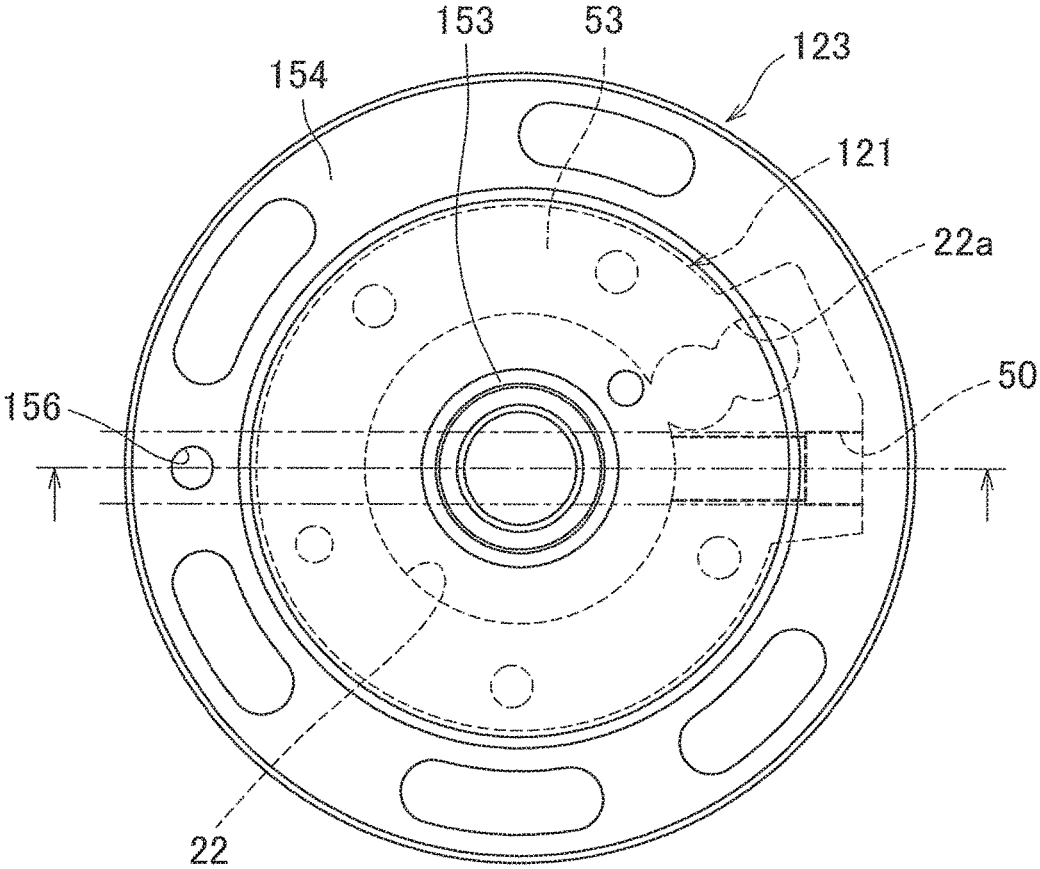
FIG. 7A is a plan view of an end surface member and a cylinder main body of the compressor of FIG. 6.
Figure 7B:
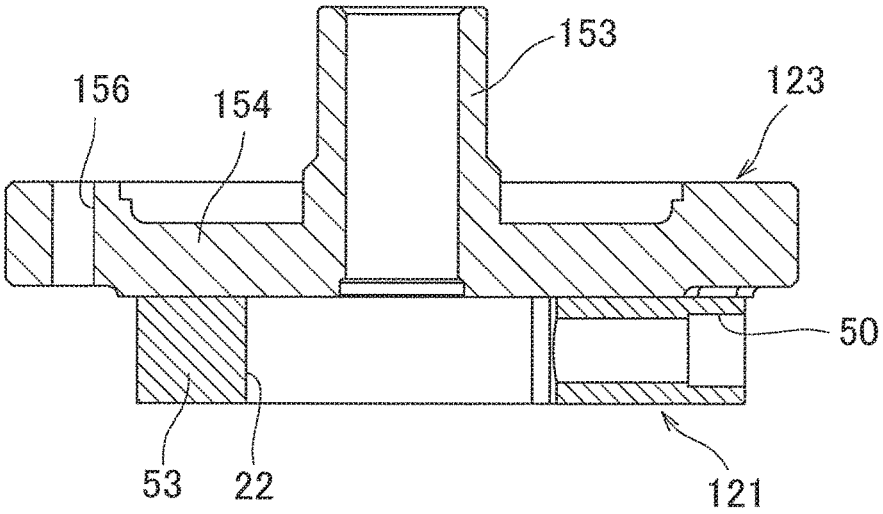
FIG. 7B is a cross section of the end surface member and the cylinder main body.
Figure 8:
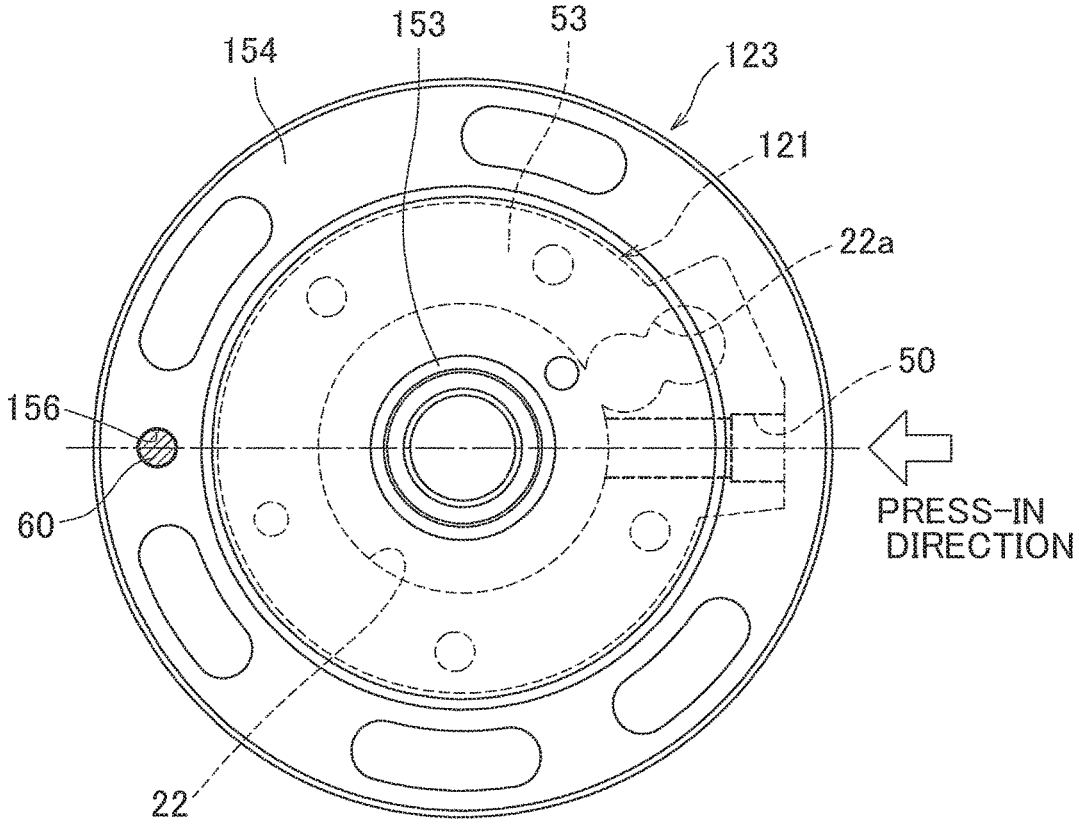
FIG. 8 is a diagram showing a state where an inlet tube is pressed in the cylinder main body of FIG. 7.

FIG. 6 to FIG. 8 show the second embodiment of this invention. The second embodiment is different from the first embodiment in that: while in the compressor of the first embodiment, the outer circumferential surface of the cylinder main body 21 of the compression mechanism 2 is fixed to the inner circumferential surface of the cylindrical member 1*a* of the cylinder main body 21 by welding, in the second embodiment, an outer circumferential surface of an end surface member 123 of a compression mechanism 102 is fixed to the inner circumferential surface of the cylindrical member 1*a* by welding. With this, there is a difference in the member in which the circular hole is located. The other structures are substantially the same as those of the first embodiment, and therefore, the explanations are omitted.

As shown in FIG. 7, a cylinder main body 121 includes the cylindrical portion 53 located around the compression chamber 22. The cylinder main body 121 has the intake hole 50. The intake hole 50 communicates with the compression chamber 22 and extends in a horizontal direction (a direction crossing the drive shaft 12). To an upper surface of the cylindrical portion 53, the end surface member 123 is fixed. The upper surface of the cylindrical portion 53 has an outline smaller than that of the end surface member 123. The end surface member 123 includes: a cylindrical portion 153 located around the drive shaft 12; and a support portion 154 extending from an outer circumferential surface of the cylindrical portion 153 to the inner circumferential surface of the casing 1. The end surface member 123 further has a circular hole 156 located in the support portion 154. The circular hole 156 is located radially outside the compression chamber 22 and radially outside the cylinder main body 121. The hole 156 extends in a direction parallel to the drive shaft 12. In a plan view, the center of the circular hole 156 is located within an area defined by extending the intake hole 50 (i.e., an area between two-dot chain lines which are extension lines from an end portion of the intake hole 50 in FIG. 7A). In the plan view of FIG. 7A, the center of the circular hole 156 is on the center line of the intake hole 50. The circular hole 156 is formed by machining or sintering. As shown in FIG. 7B, the circular hole 56 is located in the end surface member 123, while the intake hole 50 is located in the cylinder main body 121. Accordingly, with respect to the height direction of the compressor, the circular hole 156 is located higher than the intake hole 50, as shown in FIG. 7B.

The process of assembling the compressor of the second embodiment is different from that of the first embodiment in the following points: while in the process of assembling the compressor of the first embodiment, the assembly-purpose positioning pin 60 is inserted into the circular hole 56 of the cylinder main body 21, the assembly-purpose positioning pin 60 is inserted into the circular hole 156 of the end surface member 123 in the second embodiment; and while in the process of assembling the compressor of the first embodiment, the outer circumferential surface of the cylinder main body 21 of the compression mechanism 2 is fixed to the inner circumferential surface of the cylindrical member 1*a* by welding, the outer circumferential surface of the end surface member 123 of the compression mechanism 102 is fixed to the inner circumferential surface of the cylindrical member 1*a* by welding. However, the rest is substantially the same as that in the process of assembling the compressor of the first embodiment (FIG. 3 and FIG. 4), and therefore description of these is omitted.

In the process of assembling the compressor, the circular hole 156 of the end surface member 123 is used as the assembly-purpose positioning hole. Therefore, when the inlet tube 52 is pressed into the intake hole 50 in the situation where the assembly-purpose positioning pin 60 is inserted in the circular hole 156 of the end surface member 123, a force in a direction toward the assembly-purpose positioning pin 60 (circular hole 156) is exerted on the cylinder main body 121, as shown in FIG. 8. Because the assembly-purpose positioning pin 60 is at a position in a direction of the above-mentioned force exerted, the assembly-purpose positioning pin 60 prevents the cylinder main body 121 (compression mechanism 102) from being moved (rotationally moved) by this force. This prevents the problems take place in the process of assembling the known compressor (FIG. 9) including the cylinder main body 921: the problem of the cylinder main body 921 rotationally moving about the assembly-purpose positioning pin 60; and the problem of the rotor 6 attached to the drive shaft 12 also rotationally moving with the cylinder main body 921. For this reason, the spacer 61 is not pressed by a part of the circumference of the rotor 6 (cylinder main body 21). Accordingly, an air gap (air gap between the outer circumferential surface of the rotor 6 and the inner circumferential surface of the stator 5) is uniform throughout the entire circumference. When the spacer 61 is detached under the circumstances after the end surface member 123 is fixed to the inner circumferential surface of the cylindrical member 1*a* by welding, the air gap remains uniform throughout the entire circumference.

Characteristics of Compressor of this Embodiment

In this compressor and the method for producing the compressor, the compression mechanism 102 has the circular hole 156, and the center of the circular hole 56 is located within the area defined by extending the intake hole 50 in a plan view. This circular hole 156 is useable as an assembly-purpose positioning hole in the process of assembling the compressor. Now, suppose the situation where the compression mechanism 102 is positioned by inserting the assembly-purpose positioning pin 60 fixed to the support table into the circular hole 156 (assembly-purpose positioning hole) in the process of assembling the compressor. When the inlet tube 52 is pressed into the intake hole 50 in this situation, a force in a direction of rotation about the positioning pin 60 is hardly exerted to the compression mechanism 102. As a result, rotation of the compression mechanism 102 about the assembly-purpose positioning pin 60 is suppressed when the inlet tube 52 is pressed in the intake hole in the process of assembling the compressor. This makes the air gap uniform throughout the entire circumference, to prevent an increase in noise from the compressor in operation.

In the compressor of this embodiment, the circular hole 156 is formed by machining or sintering. For this reason, when the circular hole 156 is used as the assembly-purpose positioning hole in the process of assembling the compressor, the compression mechanism 102 is properly positioned.

In the compressor of this embodiment, the center of the circular hole 156 is located within the area defined by extending the intake hole 50 in a plan view. Therefore, in the situation where the circular hole 156 is used as the assembly-purpose positioning hole in the process of assembling the compressor, the rotation of the compression mechanism 102 about the assembly-purpose positioning pin is prevented when the inlet tube 52 is pressed in the intake hole 50 at the time of assembling the compressor. This makes the air gap uniform throughout the entire circumference, to effectively prevent an increase in noise from the compressor in operation.

Thus, embodiments of the present invention are described hereinabove. However, the specific structure of the present invention shall not be interpreted as to be limited to the above described embodiments. The scope of the present invention is defined not by the above embodiments but by claims set forth below, and shall encompass the equivalents in the meaning of the claims and every modification within the scope of the claims.

The above-described embodiments each deals with the case where the center of the circular hole is on the center line of the intake hole in a plan view. However, the advantageous effects of the present invention are brought about also in the following cases where: the center of the circular hole is located within the area defined by extending the intake hole in a plan view; and at least a part of the circular hole is located within the area defined by extending the intake hole in a plan view.

While the above-described embodiments each deals with the case where the assembly-purpose positioning pin having the circular horizontal cross-section is inserted into the circular hole and the circular hole is used as the assembly-purpose positioning hole, the present invention is not limited to this. The assembly-purpose positioning pin may have a horizontal cross-section which is not circular, as long as the pin is able to be inserted into the circular hole to position the compression mechanism. Further, regarding the circular hole, the size of the circular hole may be changed as long as it is usable as the assembly-purpose positioning hole. It should be noted that the present invention is unique in that the circular hole of the compression mechanism is used as the assembly-purpose positioning hole to position the compression mechanism. Now, suppose that the compression mechanism has a non-circular hole (e.g., an oval hole) which is located within the area defined by extending the intake hole in a plan view, and the non-circular hole is used as the assembly-purpose positioning hole to position the compression mechanism. This configuration is totally different from the technical idea of the present invention, for the above-described reason.

Further, in the above-described embodiments, the circular hole is located in the cylinder main body or the upper end surface member on the cylinder main body. However, the circular hole may be located in a member other than those included in the compression mechanism. For example, the circular hole may be located in the lower end surface member on the cylinder main body. Furthermore, 1 or more circular holes may be located in a plurality of members. To obtain the advantageous effects of the present invention, it is required that at least a part of the circular hole is located within the area defined by extending the intake hole in a plan view. With respect to the height direction of the compressor, the circular hole may be at the same height as, or at a different height from the intake hole.

The above-described embodiments deal with the cases where: both of the circular hole and the intake hole are located in the cylinder main body; and the circular hole is located in the upper end surface member on the cylinder main body while the intake hole is located in the cylinder main body. The circular hole and the intake hole may be located in the single member included in the compression mechanism, or may be located in respective members different from each other.

In addition, the above-described embodiments each deals with the case where the intake hole communicates with the compression chamber and extends in the horizontal direction. However, the intake hole may communicate with the compression chamber and extend in a direction crossing the drive shaft.

Moreover, in the above-described embodiments, the compression mechanism is structured so that the compression chamber is partitioned by the blade provided integrally with the roller into the high-pressure area and the low-pressure area; however, the structure of the compressor may be changed. The compression mechanism may be structured so that the compression chamber is partitioned, into the high-pressure area and the low-pressure area, by a vane which is provided separately from the roller and is pressed onto the roller by a spring.

INDUSTRIAL APPLICABILITY

The present invention enables uniform air gap throughout the entire circumference.

What is claimed is:

1. A compressor comprising:

a compression mechanism; and a drive mechanism, the compression mechanism and the drive mechanism being disposed in a casing including a cylindrical member, the drive mechanism including a stator fixed to an inner circumferential surface of the cylindrical member, and a rotor disposed inside the stator, the rotor being configured to rotate with a drive shaft, the compression mechanism including a cylinder main body having a compression chamber in which a roller driven by the drive shaft is disposed, an end surface member attached to an end surface of the cylinder main body, a muffler main body attached to the end surface member, an intake hole communicating with the compression chamber and extending in a direction crossing the drive shaft, and a circular hole located radially outside the compression chamber and extending in a direction parallel to the drive shaft, the circular hole opening, outside the muffler main body, to a space inside the casing, and at least a part of the circular hole being located within an area defined by an imaginary extension of the intake hole through the drive shaft when viewed from an axial end of the drive shaft, and the circular hole being located, in the cylinder main body, radially outside the end surface member and the muffler main body so that the circular hole is visible when viewed from a compression mechanism end of the stator.

2. The compressor according to claim 1, wherein the intake hole and the circular hole are located in a single member.

3. The compressor according to claim 1, wherein a center of the circular hole is located within the area defined by the imaginary extension of the intake hole through the drive shaft when viewed along the axial direction of the drive shaft.

4. The compressor according to claim 2, wherein a center of the circular hole is located within the area defined by the imaginary extension of the intake hole through the drive shaft when viewed along the axial direction of the drive shaft.

* * * * *